US005856651A

United States Patent [19]

Shaffer

[11] Patent Number: 5,856,651

[45] Date of Patent: Jan. 5, 1999

[54] SHIELD FOR A HOT SURFACE IGNITOR AND METHOD FOR FABRICATING A SHIELD

[75] Inventor: Peter T. B. Shaffer, Cumming, Ga.

[73] Assignee: Surface Igniter Corporation, Mayaguez, Puerto Rico

[21] Appl. No.: 55,268

[22] Filed: Apr. 6, 1998

[51] Int. Cl.[6] ..... F23Q 7/00

[52] U.S. Cl. ..... 219/270; 219/260; 219/267; 431/263

[58] Field of Search ..... 219/270, 267, 219/260; 431/263, 262, 258; 361/264–266

[56] References Cited

U.S. PATENT DOCUMENTS

| | | | |
|---|---|---|---|
| 1,631,662 | 6/1927 | Weydell . | |
| 2,616,947 | 11/1952 | Howard-Jones . | |
| 3,372,305 | 3/1968 | Mikulec . | |
| 3,562,590 | 2/1971 | Mitts et al. | 317/98 |
| 3,776,015 | 12/1973 | Charter | 72/324 |
| 3,823,345 | 7/1974 | Mitts et al. | 317/98 |
| 3,842,319 | 10/1974 | Perl | 317/98 |
| 4,029,936 | 6/1977 | Schweitzer | 319/267 |
| 4,545,339 | 10/1985 | Brooks et al. . | |
| 5,233,166 | 8/1993 | Maeda et al. | 219/552 |
| 5,494,642 | 2/1996 | Sanada . | |

*Primary Examiner*—Teresa J. Walberg
*Assistant Examiner*—Vinod D. Patel
*Attorney, Agent, or Firm*—Dougherty & Troxell

[57] ABSTRACT

An ignitor assembly includes a hot surface ignitor of a resistance material and a super alloy shield surrounding the ignitor. The shield comprises a longitudinally extending cylindrically shaped super alloy sheet having a plurality of first and second alternating transverse strips. The strips are formed by making a plurality of transverse slits or cuts in a flat sheet of super alloy material. The first alternating strips are bowed outwardly in a first direction and the second alternating strips are bowed outwardly in an opposite direction to thereby form a cage like cylindrical structure which forms a part of the ignitor assembly. The ignitor generally includes a base portion and is inserted into the cage like structure.

4 Claims, 5 Drawing Sheets

SHIELD FOR A HOT SURFACE IGNITOR AND METHOD FOR FABRICATING A SHIELD

FIELD OF THE INVENTION

This invention relates to a shield for a hot surface ignitor and more particularly to a shield of a super alloy material for a cylindrical ignitor or the like. The invention also relates to a method for fabricating an ignitor assembly which includes a super alloy shield.

BACKGROUND FOR THE INVENTION

Silicon carbide hot surface ignitors for the ignition of a vaporous fuel such as natural or artificial gas are well known. Such ignitors are typically employed in gas ovens, ranges, dryers, furnaces, and water heaters and similar appliances.

One example of a hot surface silicon carbide ignitor is disclosed in the U.S. Pat. No. 3,372,305 of Mikulec which is incorporated herein in its entirety by reference. As disclosed therein, the ignitor comprises an elongated hollow body which is made of a non-metallic resistance material such as silicon carbide. The ignitor, which is cylindrical in shape, includes a first portion which includes a pair of laterally spaced elongated members and a second portion comprising a pair of spaced helical bands which are connected to and extend longitudinally from the elongated members. There are two problems associated with the use of such ignitors. The first problem is that silicon carbide ignitors are impact sensitive and therefore require a strong impact resistant metal shield to protect them during shipment, installation and service. Such shields also provide a safety barrier to prevent accidental burns and exposure to possible electrical shock. The second problem is that the metals required for these shields must be quite resistant to the high temperatures generated by the ignitor and the subsequent gas flame. Therefore, the metals fall into the class generally referred to as super alloys.

A further problem is that the super alloy shields are relatively expensive and as such represent a disproportionate portion of the cost of a finished ignitor assembly.

One approach to shielding an ignitor is disclosed in the Schweitzer U.S. Pat. No. 4,029,936 which is also incorporated herein in its entirety by reference. As disclosed therein, an ignitor shield includes a generally box-like structure with a plurality of openings therein. These openings provides sufficient open passages for effective heat transfer from the ignitor to effect ignition of a fuel discharged in the proximity of the ignitor.

A more recent ignitor incorporates a cylindrical shield which is attached to and surrounds the ignitor with a cage-like structure. Such ignitor assemblies have for example been marketed by Surface Ignitors, Inc. the assignee of the present invention. In order to make such ignitor assemblies by the normal manufacturing process, it is necessary to start with a piece or metal, a super alloy which is somewhat wider than the circumference of the part being shielded plus the required stand-off distance. In addition it is necessary to add enough extra metal to provide for a certain amount of overlap.

It is presently believed that an ignitor shield in accordance with the present invention will significantly reduce the amount of super alloy material in an ignitor assembly and enable the production of such assemblies at a significant cost reduction. This cost reduction can be achieved without adversely affecting the durability of the assembly. It is also believed that the shields in accordance with the present invention can be installed in a conventional manner without added complexity or cost for that step of the assembly.

BRIEF SUMMARY OF THE INVENTION

In essence, the present invention contemplates a shield for a hot surface ignitor. The shield includes a longitudinally extending cage like structure which is made from a super alloy sheet having a plurality of first and second alternating transverse strips. The transverse strips are formed by a plurality of transverse cuts or slits in the alloy sheet. The shield also includes a longitudinally extending metal wall portion which is integral with the strips and adapted for mounting the shield on a hot surface ignitor. The first alternating strips are bowed outwardly in a first direction and the second alternating strips are bowed outwardly in an opposite direction to thereby form a cage like structure. In a preferred embodiment of the invention, the alternating strips form a generally cylindrical shield. However, it should be recognized that the shield may have a rectangular or other cross section with a plurality of transverse openings between the alternating strips. In the preferred embodiment of the invention the shield includes an integral longitudinally extending wall portion on two opposite sides of the shield and a tab for partial closure extending across the top of the cylinder to protect an upper portion of an ignitor which is encircled by the shield.

The invention also contemplates a method for fabricating a hot surface ignitor assembly. The method includes the step of providing a longitudinally extending hot surface ignitor having a hot surface portion, a base portion and a pair of electrodes. The method also includes the step of providing a sheet of a super alloy material with a length that is greater than the length of the hot surface portion of the ignitor and a width with is slightly greater than the circumference of the ignitor but less than twice the diameter of the ignitor. A plurality of transverse cuts is formed in the super alloy sheet to form a plurality of alternating strips or bands with an integral longitudinally extending wall portion on at least one side and preferably on each side of the strips. A first series of alternating strips is then forced or otherwise bent outwardly in a first direction to form one half of a cylindrical structure. The second series of alternating strips is also forced outwardly in an opposite direction to form the other half of the cylindrical structure. In one embodiment of the invention, the lower strips are not forced or bent outwardly to the same degree as the upper strips and are forced over the base portion of the ignitor in order to mount the shield thereon.

The invention will now be described in connection with the accompanying drawings wherein like reference numerals have been used to identify like parts.

DETAILED DESCRIPTION OF THE PREFERRED EMBODIMENTS OF THE INVENTION

Figure 1:
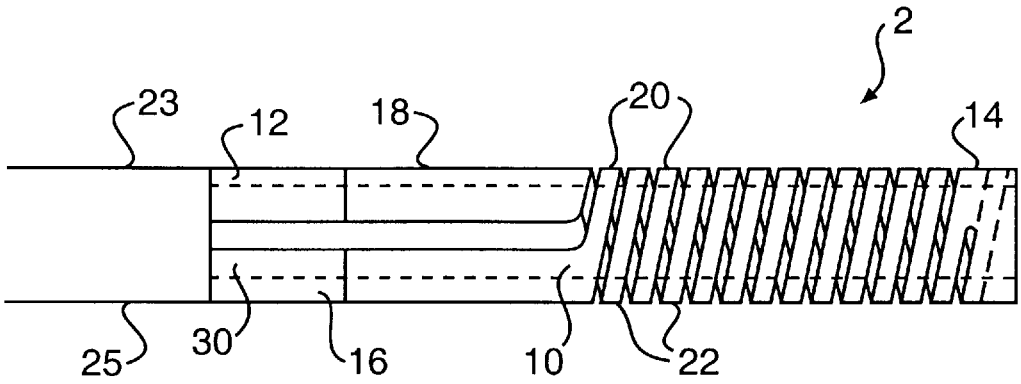
FIG. 1 is a side elevational view of a conventional silicon carbide ignitor of the type which is incorporated in an ignitor assembly in accordance with the present invention and of the type which is most suitable for use with a shield in accordance with the present invention.

As shown in FIG. 1, a conventional silicon carbide ignitor element 2 comprises an elongated hollow tubular resistance body 10, having opposite end portions 12 and 14 respectively. The body 10 is composed of a comparatively electrically conductive material such as a very dense recrystallized silicon carbide. As disclosed in the aforementioned U.S. Pat. No. 3,372,305 a pair of diametrically opposed slots is cut through the radial wall thickness of the body 10. The slots extend from the face end portion 12 and terminate about midway along the length of the body 10 to form two substantially semicircular, laterally spaced members or legs 16 and 18.

Utilizing the same cutting technique, a pair of closely spaced spiral slots is cut through the wall thickness of the body 10 extending from the ends of the legs 16 and 18 respectively, axially toward the end portion 14 to form a pair of helical bands 20 and 22. Helical band 20 extends longitudinally from leg 16 to end portion 14 and helical band 22 extends longitudinally from the leg 18 to the end portion 14. It should be recognized that the ignitors may have shorter or longer lengths of legs 16 and 18 and/or bands 20 and 22. In this manner, a continuous path is provided for electrical current through leg 16, helical band 20, end portion 14, helical band 22 and leg 18.

A pair of electrical leads 23 and 25 is attached to the legs 16 and 18 in a conventional manner as for example as disclosed in the Perl U.S. Pat. No. 3,842,319. For example, the leads 23 and 25 which may be of nichrome may be inserted into diametrically opposite centered slots (not shown) in legs 16 and 18 and bonded thereto in a conventional manner.

While the ignitor per se is a vital part of the assembly, it is of a conventional design and may be replaced by other suitable ignitors or heating elements. A key feature of the present invention resides in a shield which surrounds at least substantially all of the high temperature end of the ignitor. Such shields must provide sufficient open passages for effective heat transfer from the ignitor to affect ignition of a fuel which is discharged near the ignitor while providing protection for the ignitor as well as the appliance user. The metals required for these shields must be resistant to the high temperatures generated by both the ignitor and the subsequent gas flame. Accordingly, the metals for such shields fall into the class which is generally referred to as super alloys.

Figure 2:
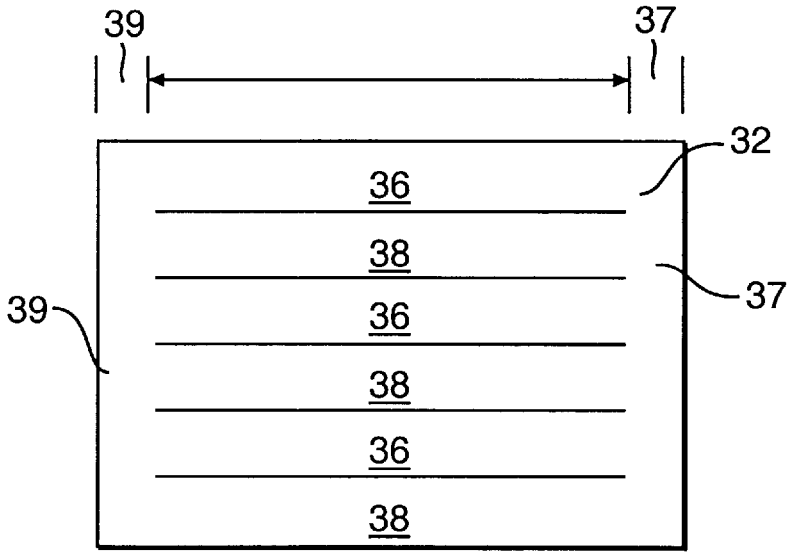
FIG. 2 is a plan view of a super alloy sheet with a series of transverse slits and a pair of integral longitudinally extending wall portions.
Figure 3:
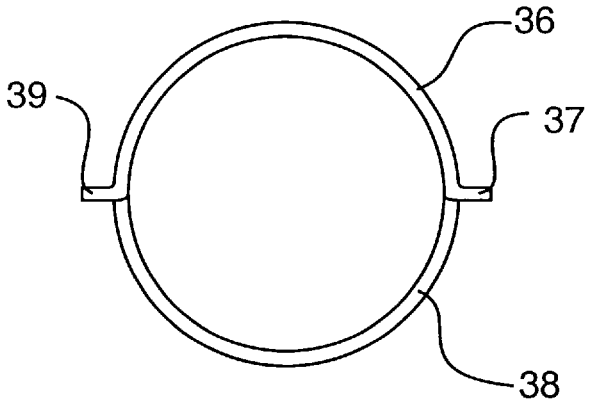
FIG. 3 is a top or plan view which illustrates a shield in accordance with one embodiment of the invention.
Figure 4:
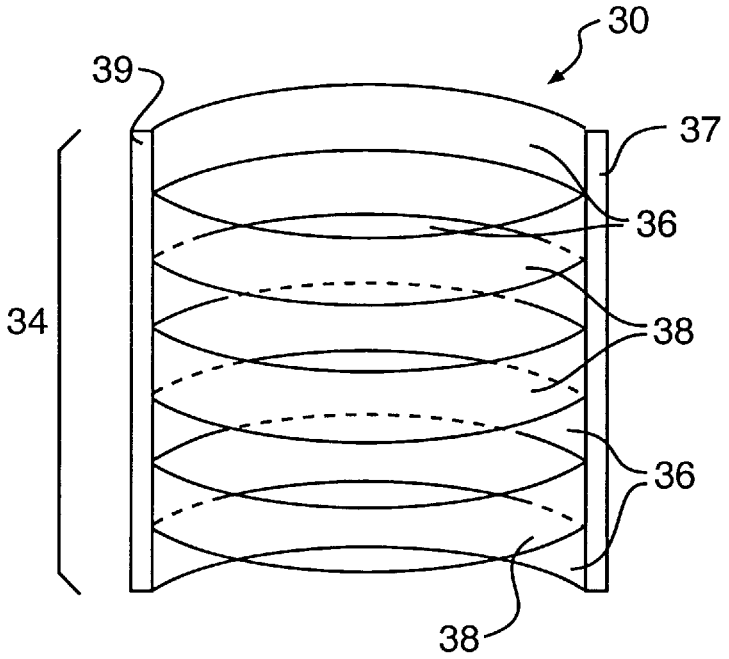
FIG. 4 is an isometric view of the ignitor shield shown in FIG. 3.

A shield 30 (see FIGS. 3–7) is formed from a single sheet 32 (see FIG. 2) of relatively strong, expensive, heat and scale resistant sheet material such as a high chrome stainless steel identified as "INCONEL 601" or other suitable material as will be understood by a person of ordinary skill in the art. The shield 30 includes a longitudinally extending cylindrically shaped super alloy structure 34 having a plurality of first and second alternating transverse strips 36 and 38 (FIG. 4). These strips 36 and 38 are formed by a plurality of transverse cuts and in the alloy sheet as illustrated in FIG. 2. The shield 30 also includes at least one and preferably two outwardly projecting longitudinally extending metal wall portions 37 and 39 which are integral with the strips 36 and 38.

Figure 7:
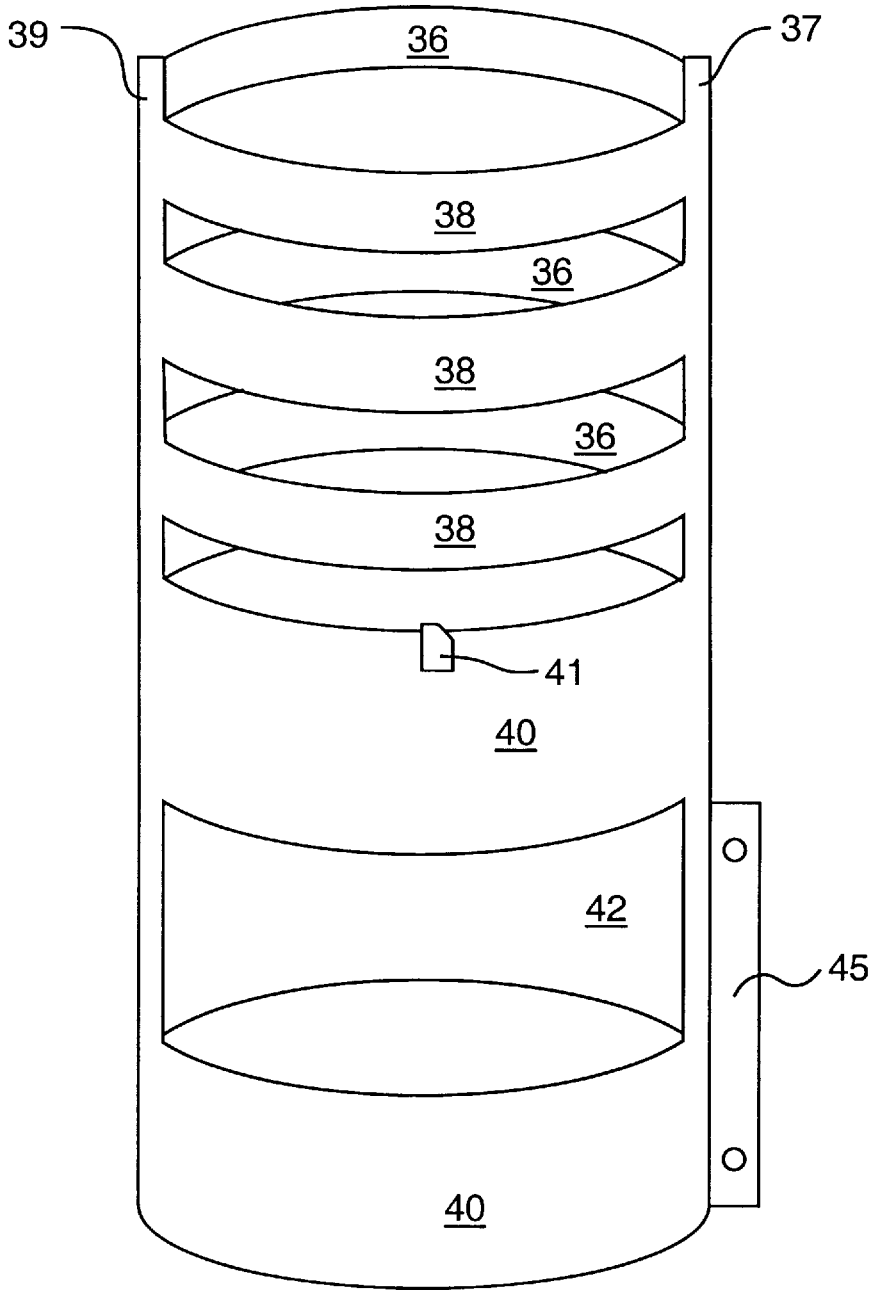
FIG. 7 is an isometric view of an ignitor shield in a still further embodiment of the invention.

In a preferred embodiment of the invention the transverse strips 36 and 38 and spacings therebetween have a width of about 0.2 inches in an area adjacent to the hot surface of the ignitor. The spacing should be extended to or less than 0.25" in order to minimize the chance of articles coming into contact with the ignitor body. The strips or segments 40 and segment 42 that contact the base of an ignitor assembly may in fact be considerably wider as shown in FIG. 7. In addition, the top most portion of the wider band i.e. segment 40 has a small tab 41 which is bent inwardly to provide a mechanical stop to prevent the shield from being forced too far down on the assembly. As shown a mounting tab or bracket 45 is used for mounting the assembly in an appliance in a conventional manner.

Figure 5:
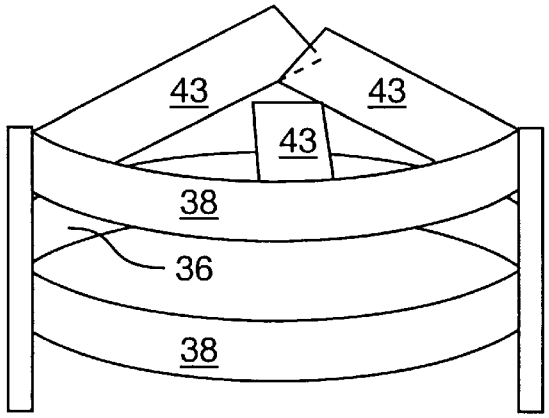
FIG. 5 is an isometric view of an ignitor assembly in accordance with another embodiment of the invention.
Figure 5A:
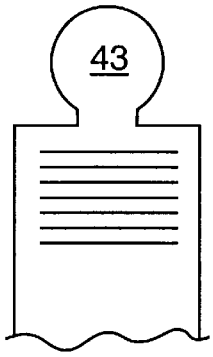
FIG. 5*a* is a schematic illustration of an alternate tab for partially closing the top of a cage like structure.
Figure 6:
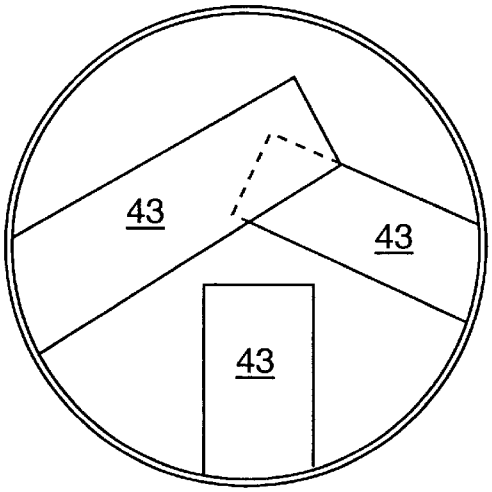
FIG. 6 is a top view of the ignitor shield shown in FIG. 5.
Figure 6A:
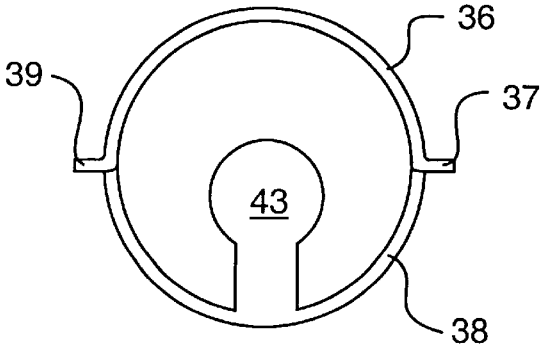
FIG. 6*a* is a top or plan view showing the tab and shield shown in FIG. 5*a;*

Referring more particularly to FIGS. 5 and 6, the shield assembly may also include one or more tabs 43 which extend upwardly from the strip 38 and which are bent inwardly to close a portion of an upper end of the shield.

Figure 8:
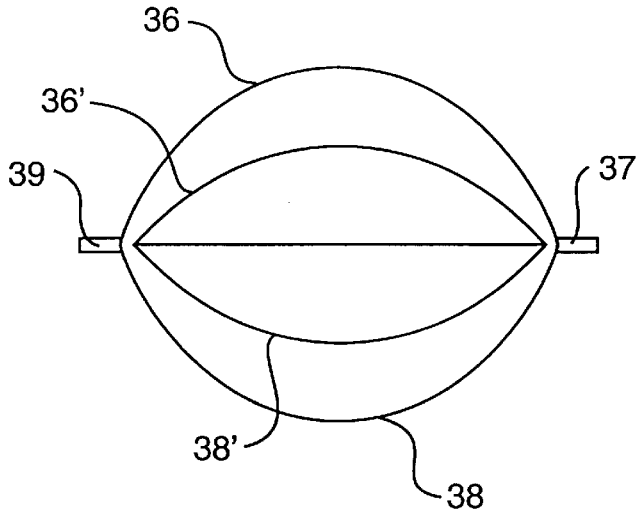
FIG. 8 is a top plan view of the ignitor shield shown in FIG. 7.
Figure 9:
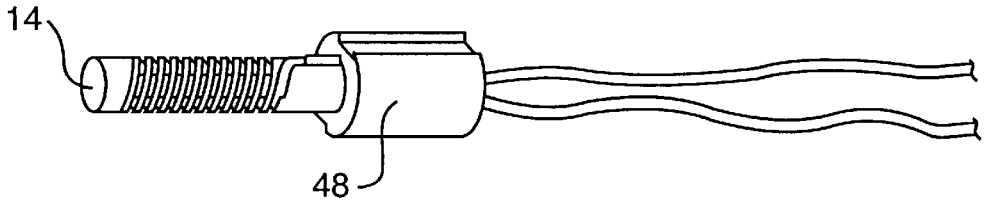
FIG. 9 is an isometric view of a prior art ignitor according to the prior art.

As illustrated in FIG. 8, the lower strips and segments 40 and 42 may be bowed only partially outwardly ie to form an elliptical like lower portion which engages a lower portion of an ignitor assembly ie a ceramic base or holder 48 in the manner shown. An upper portion may also be similarly formed to partially close the top of the shield.

Figure 10:
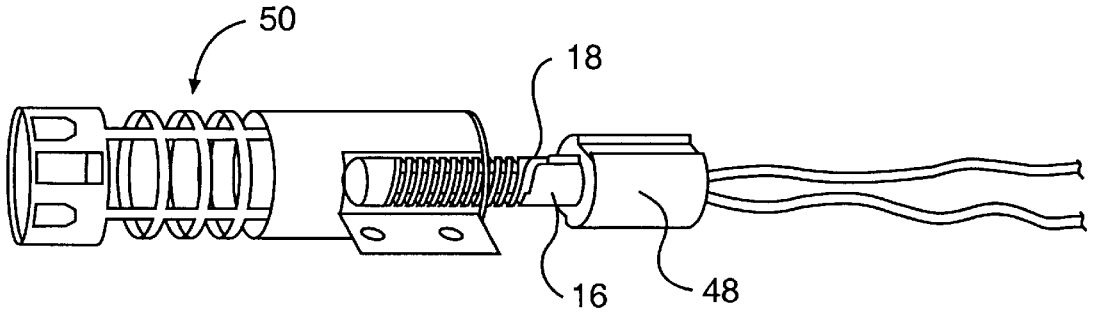
FIG. 10 PRIOR ART
FIG. 10 is a partially exploded perspective view of a prior art ignitor assembly.

FIG. 10 illustrates a conventional shield 50.

While the invention has been disclosed in connection with its preferred embodiments, it should be recognized that changes and modification may be made therein without departing from the scope of the following claims.

What is claimed is:

1. A hot surface ignitor assembly including a hot surface ignitor and a longitudinally extending generally cylindrically shaped super alloy shield extending around said ignitor, said ignitor comprising an elongated hollow body composed of a non-metallic resistance material and having a first portion comprising a pair of laterally spaced elongated members having inner and outer surfaces and a second portion comprising a pair of spaced helical bands connected to and extending longitudinally from said elongated members respectively and terminating in an end portion, a coating of electrically conductive material disposed on one of said surfaces of each of said elongated members remote from said helical bands, and said shield comprising a longitudinally extending cylindrically shaped super alloy metal sheet having a plurality of odd and even alternate transverse strips formed by a plurality of transverse slits, and a longitudinally extending metal wall portion integral with said strips and wherein said odd alternate transverse strips are bowed outwardly in a first direction and wherein said even alternate strips are bowed outwardly in an opposite direction to thereby form a longitudinally extending cylindrical shield between said strips with said ignitor disposed within said cylindrical shield and means for fixing said shield to said ignitor.

2. A hot surface ignitor assembly according to claim 1 in which said shield includes a second longitudinally extending wall portion which is integral with said strips and in which said second longitudinally extending wall portion is transverse to said first longitudinally extending wall portion.

3. A hot surface ignitor assembly according to claim 2 in which the spacing between said alternating strips in an upper portion of said assembly does not exceed 0.25 inches.

4. A hot surface ignitor assembly according to claim 3 in which the alternating strips in an upper portion of said shield are spaced apart by a distance which is less than the distance between strips in a lower portion of said shield.

* * * * *